United States Patent [19]

Uken

[11] Patent Number: 4,647,717

[45] Date of Patent: Mar. 3, 1987

[54] GEL FILLED CONTAINER

[75] Inventor: William D. Uken, Fremont, Calif.

[73] Assignee: Raychem Corp., Menlo Park, Calif.

[21] Appl. No.: 730,694

[22] Filed: May 2, 1985

[51] Int. Cl.[4] ..... H01R 4/22

[52] U.S. Cl. ..... 174/84 C; 174/74 A; 174/76; 339/115 C

[58] Field of Search ..... 174/74 A, 76, 84 C; 339/97 C, 114, 115 R, 115 C, 276 R, 276 C

[56] References Cited

U.S. PATENT DOCUMENTS

| | | | |
|---|---|---|---|
| 1,965,151 | 7/1934 | Mueller | 174/74 A |
| 2,429,585 | 10/1947 | Rogoff | 339/276 R |
| 3,064,072 | 11/1962 | Graff et al. | 174/84 C |
| 3,150,233 | 9/1964 | Dinger | 174/84 C |
| 3,390,227 | 6/1968 | Shlesinger, Jr. | 339/97 C |
| 3,410,950 | 11/1968 | Freudenberg | 339/97 C |
| 3,585,275 | 6/1971 | Gillemot | 174/87 X |
| 3,739,470 | 6/1973 | Eppler | 174/84 C X |
| 3,768,941 | 10/1973 | D'Ascoli et al. | 174/87 X |
| 3,879,575 | 4/1975 | Dobbin et al. | 174/76 X |
| 4,039,742 | 8/1977 | Smith | 174/87 |
| 4,196,308 | 4/1980 | Siden | 174/84 C |
| 4,485,268 | 11/1984 | Kaplan | 174/84 C |
| 4,504,699 | 3/1985 | Dones et al. | 174/84 C X |

FOREIGN PATENT DOCUMENTS 0108518 5/1984 European Pat. Off. .

*Primary Examiner*—Morris H. Nimmo

*Attorney, Agent, or Firm*—Dennis E. Kovach; Herbert G. Burkard

[57] ABSTRACT

An end cap for protecting a substrate includes an outer band disposed around a gel container in a vicinity of a crimp ring, the outer band protecting the container from being pierced by a crimping tool, and keeping a material of the container deformed subsequent to crimping the crimp ring so as to prevent separation between the container and the crimp ring due to relaxation.

16 Claims, 5 Drawing Figures

GEL FILLED CONTAINER

BACKGROUND OF THE INVENTION

The present invention relates to an apparatus for sealing and protecting substrates, in particular electrical conductors.

Various apparatuses have been proposed in the prior art for protecting substrates from adverse environmental effects, so as to provide either electrical insulation, corrosion protection, or both. One prior art method has been to paint such substrates, this method being obviously disadvantageous in that it is time consuming, provides protection for only relatively short periods of time, and reentry is difficult. Other methods include the provision of applying greases about such substrates, and the disadvantage of this method is that greases do not tend to be overly stable when subjected to temperature and humidity cycling. Also, reenterability is messy since greases tend to be viscous and adhere to the substrate when a container for containing the grease is removed from the substrate.

Gels having cone penetrations between 100 and 350 ($10^{-1}$ mm) and ultimate elongations in excess of 200% are known for protecting substrates, as for example as explained in copending U.S. Ser. Nos. 434,011 filed Oct. 12, 1982; 504,000 filed June 13, 1983, a continuation-in-part of U.S. Ser. Nos. 434,011; 507,433 filed June 23, 1983 now abandoned, a continuation-in-part of both the '011 and '000 applications; 756,559, filed July 17, 1985, a continuation of the '433 application; and 646,555 filed Aug. 31, 1984, now abandoned in favor of two continuations-in-part, U.S. Ser. Nos. 772,072 and 772,073 both filed Sep. 3, 1985 and U.S. Ser. No. 859,162 filed May 2, 1986 as a continuation-in-part of U.S. Ser. No. 772,073, all assigned to the assignee of the present invention, the disclosures of which are incorporated herein by reference.

In particular, copending U.S. Ser. No. 507,433 discloses a crimp ring connector having a gel of the type described in a center portion thereof. To make electrical connection between first and second wires, an outer portion of the container containing the gel is compressed so as to compress the crimp ring therewithin into contact with the first and second wires. Though this method and corresponding apparatus provide an excellent means of electrically interconnecting first and second wires, it is disadvantageous in that the apparatus is not practicable when only corrosion protection is desired rather than electrical connection since the metal crimp ring may inadvertently pierce insulation layers on the conductors and short them out. Also, the container for the gel tends to be unduly expensive since it must be made of a relatively high quality material which is capable of not being pierced so as to maintain its physical integrity upon being crimped. In addition, a further disadvantage is that the material from which the container is made tends to relax over time which encourages separation between the crimp ring and the material of the container which can potentially form a void for moisture condensation, and also results in a relatively low crimp retention force.

SUMMARY OF THE INVENTION

Accordingly, it is an object of the present invention to eliminate these and other disadvantages, and to provide a crimpable apparatus which is relatively inexpensive, which is easy to use, which will not short out electrical conductors, which does not form voids therewithin over time due to relaxation of a material containing a gel, and which provides a relatively large pull out resistant force.

These and other objects are achieved by the provision of an apparatus which includes a container for containing the gel which is made of a relatively inexpensive material, the container being surrounded in a vicinity of a crimp ring by a relatively high performance material being capable of withstanding crimping forces of a tool used to crimp the end cap without being pierced thereby, capable of maintaining a crimped attitude subsequent to being crimped so as to prevent relaxation of a material of the container subsequent to a crimping operation, the apparatus containing a further band on an interior surface of the container in a vicinity of the crimp ring which can be made electrically insulating if desired to prevent electrical connection with a substrate being protected and the crimp ring, optimally the inner band having teeth formed thereon to form an optimum connection force with the substrate.

DESCRIPTION OF THE PREFERRED EMBODIMENTS

Figure 1:
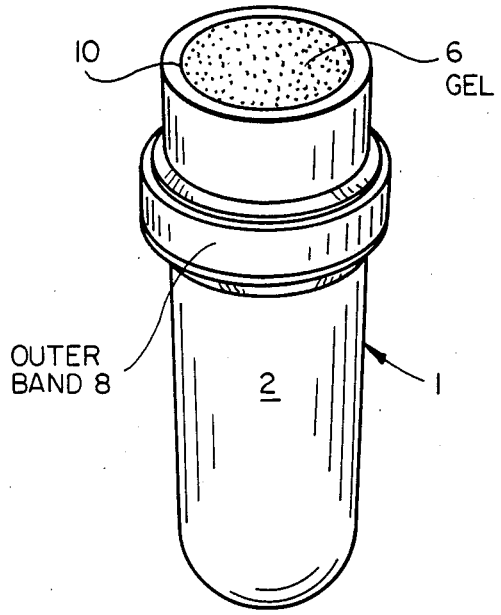
FIG. 1 is a perspective of one embodiment of the invention.
Figure 2B:
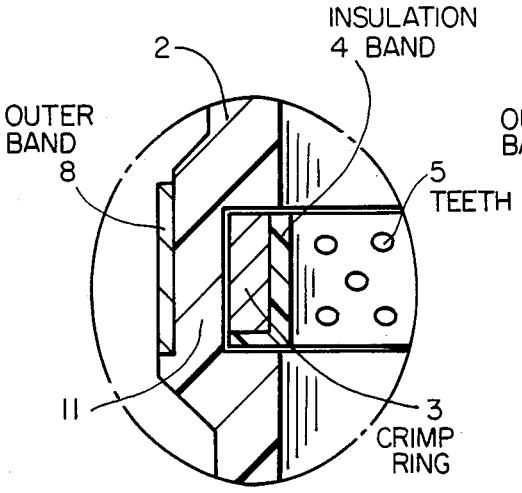
FIG. 2B is an enlarged portion of the sectional view of another embodiment of the invention.
Figure 2A:
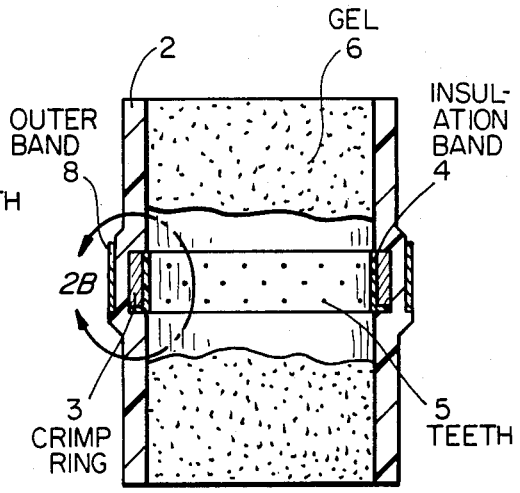
FIG. 2A is a sectional view of another embodiment of the invention.
Figure 3:
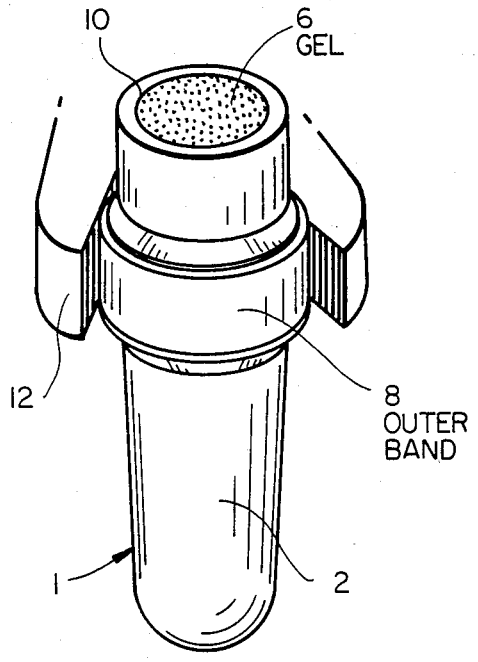
FIG. 3 is a perspective view of the embodiment of FIG. 1 being crimped by a crimping tool.

FIGS. 1–3 illustrate preferred embodiments of the invention, with FIGS. 1 and 3 being perspective views of one embodiment, with FIG. 3 illustrating a tool 12 for crimping or installing an end cap 1 constructed according to the teachings of the invention. FIG. 2 illustrates an embodiment similar to FIGS. 1 and 3 except that in FIG. 3 both opposite ends of the apparatus are open, whereas the end cap of FIGS. 1 and 3 have only one open end.

Referring to FIGS. 1–3, the apparatus includes an elastomeric boot 2, a crimp ring 3, an insulation band 4 having teeth 5 thereon, and outer band 8, and a gel 6 contained within end cap 1. The gel comprises a material having an open loop network, preferably a three-dimensional network, which has a cone penetration value of 100 to 350 ($10^{-1}$ mm), and an ultimate elongation of at least 200%, all cone penetration values cited being determined in accordance with American National Standard Designation ASTM D217-68 on an undisturbed sample at 70° C.+/−5° F. using a standard 1:1 scale cone (cone weight 102.5 g, shaft weight 37.5 g), the penetration being measured after five seconds, with all ultimate elongations being determined in accordance with American National Standard Designation ASTM D638-80, at 70°+/−5° F., using a Type 4 die to cut the sample at a speed of 50 cm/minute. A preferred cone penetration is 150–300 ($10^{-1}$ mm), more preferably 200–300 ($10^{-1}$ mm), and most preferably 240–280 ($10^{-1}$ mm), with a preferred ultimate elongation being in excess of at least 500%. Examples of such gels are taught in copending U.S. Ser. Nos. 434,011; 504,000; 507,433; and 646,555, all cited above. Materials from which such gels are formed can be urethanes, silicones, or non-silicone liquid rubbers with little to no unsaturation prior to being crosslinked, the urethanes and silicones as well as non-liquid silicones each being partially crosslinked subsequent to curing thereof. Such gels are, in particular, elastic and conformable, and preferably the gel has a tacky surface.

In use, a substrate to be protected, such as for example an electrical connection which may include a bolt and nut, is inserted into an open end 10 of the end cap 1 so as to extend past the crimp ring 3, and subsequently a tool 12, such as a pair of pliers, is disposed around the elastomeric boot 2 in a position adjacent the ring 3 such that a clamping force is applied to the end cap 1 so as to deform the crimp ring 3 so as to exert pressure on a portion of the substrate and keep it within the end cap. To increase a gripping force on the substrate, optionally the internal band 4 as described can be provided, and preferably the internal band 4 has formed thereon teeth 5 which function to better grip the substrate. In addition, if an insulating connection is desired to be made with the substrate, the internal band 4 can be made of an insulative material which is non-conductive so that any penetration by the teeth 5 through an outer protective layer of the substrate will not make electrical connection with any electrical component therewithin. Also, the ring 4 electrically isolates the ring 3 and the substrate. Accordingly, with the provision of the internal band 4, the crimp ring 3 can be made of metal to give maximum crimp retention forces without risking an electrical short.

Furthermore, if desired, optionally the outer band 8 can be disposed over an exterior surface of the boot 2, with the outer band 8 being formed from a relatively high strength material capable of withstanding compression forces by the tool 12 without being pierced or unduly damaged thereby. With the provision of the outer band 8, a material from which the boot 2 is formed can be relatively soft and accordingly relatively inexpensive, and accordingly the boot 2 can comprise a cheap elastomeric boot.

The band 8 can be either made of a metal material or a high strength polymer material, primarily the material being one which is stronger than the material from which the boot 2 is formed, which allows the material of boot 2 to be optimized to suit the environment in which the end cap will be used, such as an environment exposed to rather extreme temperature and humidity cycling conditions, acidic or saline conditions, high electrical stress conditions, etc. Accordingly, since the outer band 8 deforms in much the same manner as the crimp ring 3, a portion of the boot 2 therebetween, as indicated by reference number 11 in FIG. 2, is not able to relax over time so as to maintain compressive crimp forces on the crimp ring and the substrate being protected thereby providing increased resistance to pull out forces.

The internal band 4 is likewise formed of a high quality polymer capable of engaging the substrate with a force sufficient to maintain the substrate in position, and if it is not a concern whether or not the end cap makes electrical connection with the substrate, the band 4 can be made of a metal. In this case, however, it may be preferable to simply dispense with the use of the band 4 and simply use a crimp ring 3, which can be made metalic, and which can have gripping features formed on an inner surface thereof if desired.

Figure 4:
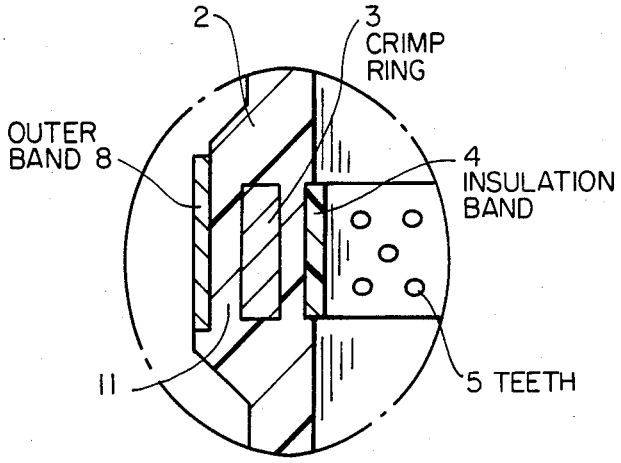
FIG. 4 is yet another embodiment of the invention showing an alternative positioning of the crimp ring utilized in the embodiments of FIGS. 1–3.

FIG. 4 illustrates another preferred embodiment similar to that shown in FIGS. 1–3. In FIG. 4 the crimp ring is completely surrounded by the boot 2, whereas in FIGS. 1–3 the crimp ring 3 is disposed within a recess found in the boot.

In the embodiment of FIG. 3, both opposite ends of the apparatus are open to allow sealing of an in-line connection, as opposed to a butt connection.

The apparatus of the invention is simple in design and easy to install about a substrate, an additional advantage being that the apparatus has very favorable versatility in that a variety of sized substrates can be accommodated within a fixed sized apparatus. Also, the apparatus can be produced relatively inexpensively since the boot 2 can simply be dip molded around the crimp ring 3. Suitable substrates for protection with the apparatus of the invention include any type of electrical or mechanical connection wherein it is desired to either electrically and/or chemically isolate and protect the connection, other substrates being any kind of material wherein either electrical and/or chemical protection is desired. A typical example of a suitable substrate is a motor connection wherein first and second conductors are interconnected by a nut and bolt, and it is desired to protect the nut and bolt, as well as the electrical connector elements connected therewith from both corrosion and from electrical discharge. In this case, the gel is formulated so as to be both electrically insulating, water repellant, and environmentaly stable.

Though the invention has been described with regard to certain preferred embodiments thereof, it should be understood that the invention is not intended to be limited thereby. Specially, though an end cap has been described as a preferred embodiment, it should be understood the apparatus could just as well be formed with both opposite ends thereof open to protect first and second substrates interconnected in an interior of the container in an in-line manner. Other modifications can also be made within the spirit of the invention, and accordingly the invention and is to be limited only by the appended claims.

What is claimed is:

1. An apparatus for protecting a substrate, comprising:

a container made of a first material;

an elastic gel having a cone penetration between 100 and 350 ($10^{-1}$ mm) and an ultimate elongation in excess of 200%, the gel being disposed in the container and being cured prior to contacting a substrate to be protected;

a crimp ring secured to the container;

a band disposed around an external surface of the container in a vicinity of the crimp ring, the band being made of a material which is stronger than the first material, and insulation means disposed adjacent the crimp ring so as to be deformed with the crimp ring for gripping the substrate and for preventing electrical contact between the crimp ring and the substrate when the crimp ring is crimped about the substrate.

2. The apparatus of claim 1, the insulation means having teeth on an inner surface thereof for gripping the substrate.

3. The apparatus of claim 1, the crimp ring being disposed within an inrerior portion of the container so as to be totally enclosed thereby.

4. The apparatus of claim 1, the crimp ring being disposed within an internal recess of the container.

5. The apparatus of claim 1, the gel having a cone penetration between 200 and 300 ($10^{-1}$ mm).

6. The apparatus of claim 5, the gel having a cone penetration between 240 and 280 ($10^{-1}$ mm).

7. The apparatus of claim 5, the gel having an ultimate elongation in excess of 500%.

8. The apparatus of claim 1, comprising electrical conductors as a substrate.

9. The apparatus of claim 1, the first material being disposed adjacent the crimp ring by dip molding the first material onto the crimp ring.

10. An apparatus for protecting a substrate, comprising:

a container made of a first material;

an elastic gel having a cone penetration between 100 and 350 ($10^{-1}$ mm) and an ultimate elongation in excess of 200%, the gel being disposed in the container and being cured prior to contacting a substrate to be protected;

a crimp ring secured to the container; and insulation means disposed adjacent an interior of the container so as to be deformed with the crimp ring for gripping the substrate, the insulation means being for insulating the substrate from the crimp ring.

11. The apparatus of claim 10, further comprising a band disposed around an external surface of the container in a vicinity of the crimp ring, the band being made of a material which is stronger than the first material.

12. The apparatus of claim 10, the insulation means having teeth on an inner surface thereof for gripping the substrate.

13. The apparatus of claim 10, the gel having a cone penetration between 200 and 300 ($10^{-1}$ mm).

14. The apparatus of claim 13, the gel having a cone penetration between 240 and 280 ($10^{-1}$ mm).

15. The apparatus of claim 14, the gel having an ultimate elongation in excess of 500%.

16. The apparatus of claim 10, comprising electrical conductor as a substrate.

* * * * *